US007316316B2

(12) United States Patent
Lombardi et al.

(10) Patent No.: US 7,316,316 B2
(45) Date of Patent: Jan. 8, 2008

(54) COMBINED RECEPTACLE AND DISPLAY CARD

(75) Inventors: Carl Lombardi, Lloyd Harbor, NY (US); Jack Albanese, Freeport, NY (US); Morris Sussman, Bellmore, NY (US)

(73) Assignee: Lombardi Manufacturing & Design, Freeport, NY (US)

( * ) Notice: Subject to any disclaimer, the term of this patent is extended or adjusted under 35 U.S.C. 154(b) by 0 days.

(21) Appl. No.: 10/392,033

(22) Filed: Mar. 19, 2003

(65) Prior Publication Data

US 2004/0182735 A1 Sep. 23, 2004

(51) Int. Cl.
*B65D 73/00* (2006.01)

(52) U.S. Cl. ..... 206/463; 206/471

(58) Field of Classification Search ..... 206/462, 206/463, 461, 471, 779, 485, 477
See application file for complete search history.

(56) References Cited

U.S. PATENT DOCUMENTS

| | | | | | |
|---|---|---|---|---|---|
| 3,044,618 | A | * | 7/1962 | Surloff | 206/462 |
| 3,212,637 | A | * | 10/1965 | Shippee | 206/467 |
| 4,091,927 | A | * | 5/1978 | Lunsford | 206/459.5 |
| 5,031,383 | A | * | 7/1991 | Hustad | 53/432 |
| 5,875,893 | A | * | 3/1999 | Lee et al. | 206/463 |
| 5,888,565 | A | * | 3/1999 | Gics | 426/124 |

* cited by examiner

*Primary Examiner*—Jila M. Mohandesi
(74) *Attorney, Agent, or Firm*—Bradley N. Ruben

(57) ABSTRACT

An integred display card and goods holding container is provided. A well for the goods is formed integrally with the card, the integral structure preferably made of plastic but can be made of wood or metal. A cover is provided for closing the well, such as a screw top. The cover and the card can be provided with structures, such as pawls and catches, so that when the cover is fully engaged with the well, the structures provide evidence of tampering if the cover is removed from the card. Alternatively, or in addition, entire card can be shrink-wrapped or a seal, such as a tamper proof seal, can be placed over the cover.

4 Claims, 4 Drawing Sheets

COMBINED RECEPTACLE AND DISPLAY CARD

BACKGROUND OF THE INVENTION

1. Field of the Invention

This invention relates to a container or receptable that is also suitable as a display card for a peg board or pull strip.

2. Background of the Invention

Consumer packaging takes many forms, some of which adapt the packaging to a particular type of display. For example, an item for sale can be blister-packed to a card, or a plastic shell can be stapled or thermoformed onto a card. Such a card can have a hole to accomodate a peg for display on a pegboard, or an opening to accomodate a pull strip. A "pull strip" is a plastic strip having a plurality of hooks, edges, or other devices that can be inserted through an opening in a card to support the card on the strip, or can be a strip having clips into which display cards are inserted; the retail consumer then merely pulls the card from the strip.

In the area of drugs and cosmetics, the particular article is typically packaged in a first package, such as a plastic pouch for pills/capsules or a small container or jar for cosmetics (e.g., lip gloss, eye shadow, powder). This first container is then packaged in a second container, such as the above-noted blister packed or thermoformed cards.

SUMMARY AND OBJECTS OF THE INVENTION

In light of the foregoing, it would be beneficial to provide a integrated combined receptacle and display card so that separate packaging is not needed for the goods and also the packaged goods. It would also be beneficial to provide such packaging having a section for the goods that is reclosable or reusable.

DETAILED DESCRIPTION OF SPECIFIC EMBODIMENTS

Figure 1:
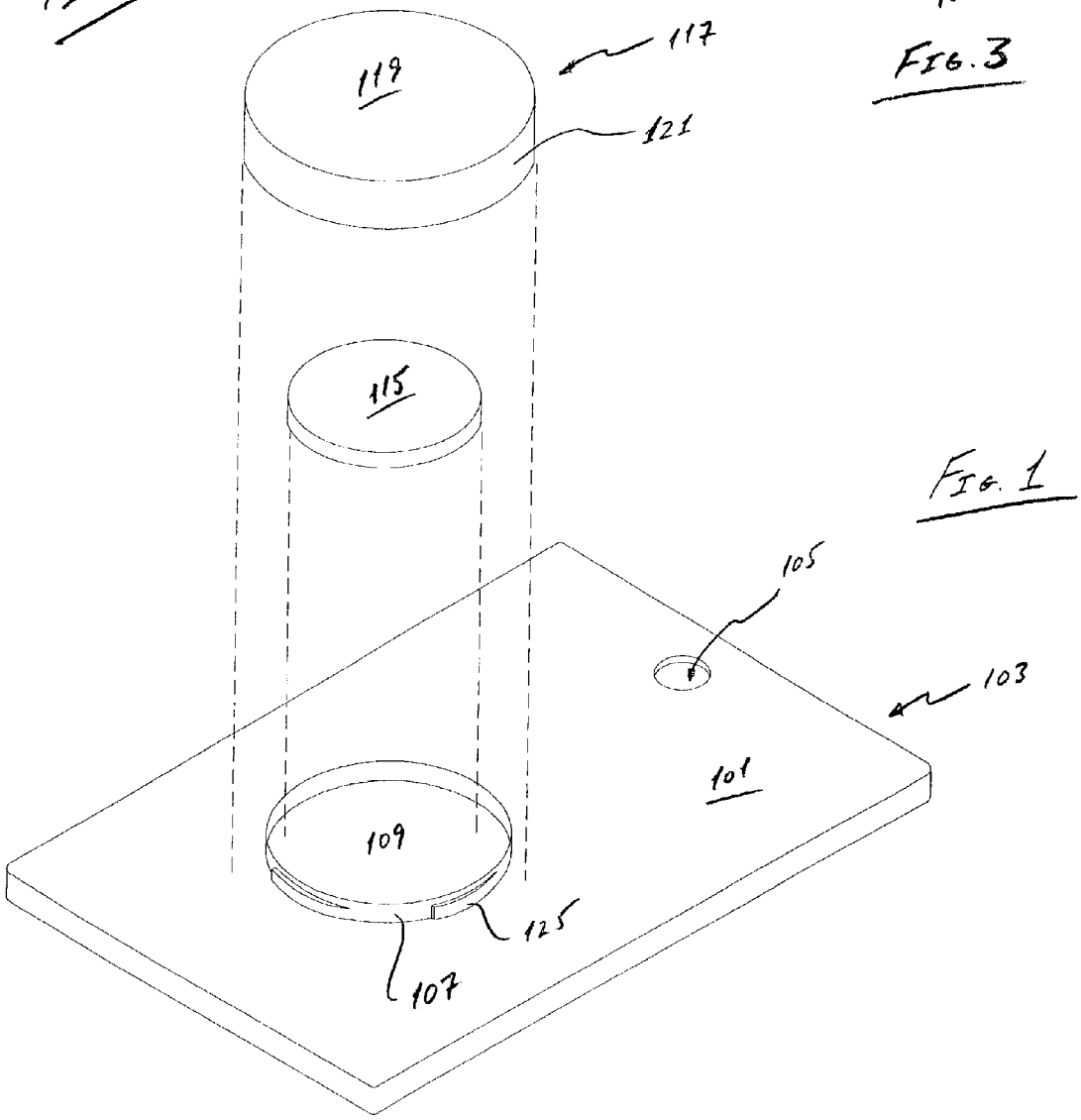
FIG. 1 is an idealized exploded perspective view of an embodiment of the integral, combined packaging of this invention.

As shown in FIG. 1, the device generally comprises a card substrate 101 having a top portion 103 in which an opening 105 is provided for attaching the card to a peg board or strip or other display device. The card substrate is preferably made of a relatively rigid plastic, such as polystyrene, polypropylene, a polyethylene, a vinyl polymer (e.g., PVC), or the like. Nevertheless, the device could be made of metal, wood, or even ceramic. Formed integrally with the card substrate is an upstanding wall 107 connecting to itself effective to provide a well 109 in which goods (powder, pills, lip gloss or lip balm) are stored. Instead of forming the wall integrally with the card, a wall can be attached directly to the card so that the card forms the bottom of the well, but it is preferred that the wall be formed integrally with the card. As shown in FIG. 1, the goods 115 (an idealization) then sit in the well. A closure 117 can also be provided having a top 119 and a depending side wall 121. The closure is secured to the wall 107 and/or to the card 101 around the outside of the wall 107. The closure can be made of the same or a different material than the card and upstanding wall.

Figure 2:
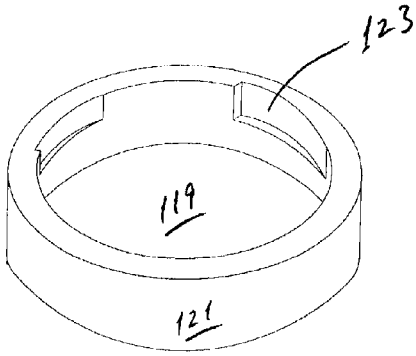
FIG. 2 is an idealized perspective view of the underside of the closure in FIG. 1.

As shown in FIG. 2, the underside of the closure, for example, the closure and the wall may have engageable threads, or as shown in FIG. 2 the closure can have a series of wedge-shaped cutouts 123 and the wall can have a series of wedge-shaped extensions 125 that engage. In this latter embodiment, the cutouts and extensions are aligned so that the closure can be brought over the well, and then the closure is turned (rotated as if being screwed) so that the cutouts and extensions are wedged together.

Figure 3:
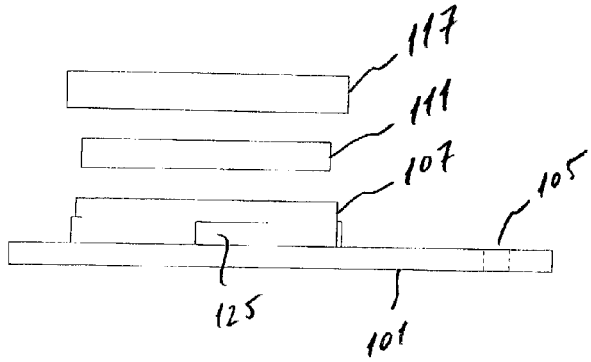
FIG. 3 is a an idealized exploded side view of the device in FIG. 1.

FIG. 3 depicts an exploded side view of the device.

Figure 5:
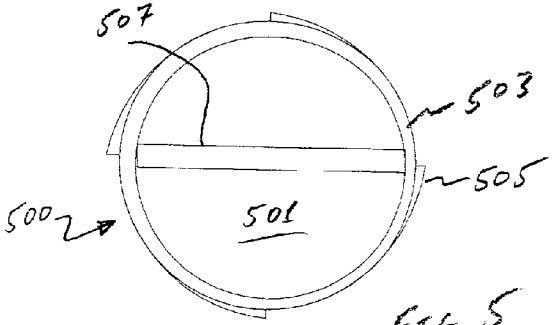
FIG. 5 is a top view of a closure suitable for use with the device in FIG. 4.
Figure 4:
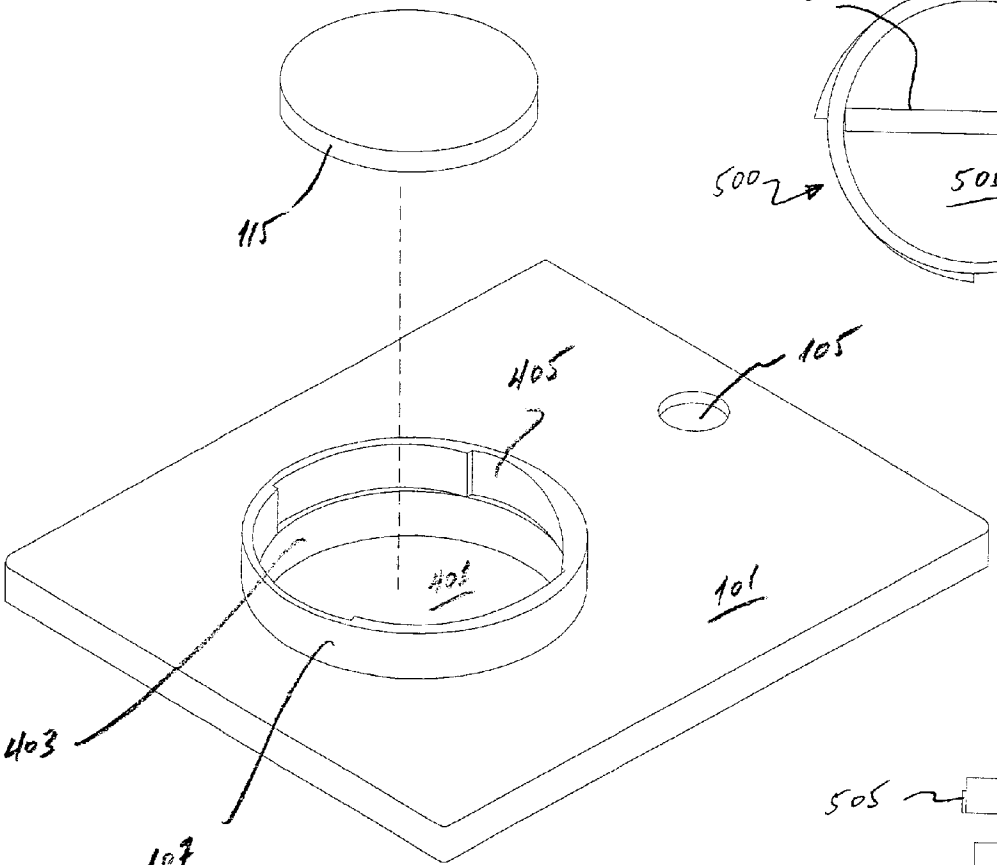
FIG. 4 is an idealized partially exploded perspective view of another embodiment of the integral, combined packaging of this invention.

FIG. 4 depicts an exploded perspective view of another embodiment of the invention, in which a recessed well 401 is provided in the card substrate 101. The recessed well is defined by a side wall 403. The cover 111, as in the device shown in FIG. 1, covers the goods 115 disposed in the recessed well having a recessed side wall 403 as well as an upper wall 107 as in the device shown in FIG. 1. On the inside of the side wall 107 are a series of wedge-shaped cutouts 405. Shown in FIG. 5 is a top view of a type of closure 500 for the device shown in FIG. 4, including a base 501 attached to a closure wall 503 from which extend a series of wedge-shaped extensions 505. Thus, the closure is placed on top of the cover and rotated so that the extensions 505 engage the cutouts 405. Of course, as mentioned above, the closure and wall can engage by screw threads. Alternatively, the card substrate can have a series of openings around the wall and the closure can include a series of depending members that pass through the holes and have an opening (e.g., "L"-shaped elements) that can engage the side of the card when the closure is rotated, and allows the closure to be removed when rotated the other way. The closure preferably has a bar 507 suitable for use as a finger hold for rotating the closure for engaging or releasing it from the wall or the card.

Figure 6:
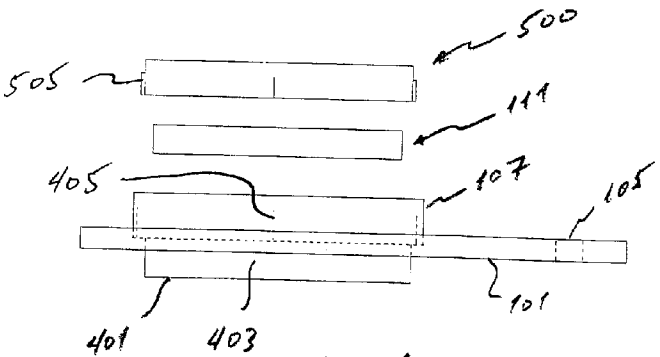
FIG. 6 is a an idealized exploded side view of the device in FIG. 1.9

FIG. 6 is an exploded side view of an embodiment of the device shown in FIG. 4.

Any type of solid or semi-solid material, or individual items, can be stored an sold in the present devices. Exemplary of such items are: cosmetic powders (e.g., eye shadow), gels and semisolids (e.g., lip gloss, lip balm); sunscreen; medications in solid form (e.g., pills, tablets, capsules, gelcaps) or semi-solid form (e.g., cream, ointment, gel, or lotion); spices or condiments, in solid or semisolid form; touch-up or other paint; candy, gum, mints, or the like; or anything else that can be packaged in such a container.

The closure can be secured in the closed position by gluing the closure to the card, or by shrink-wrapping the entire device. A foil seal can be provided over the cover to protect the goods and/or as a tamper evident device. The portion of the card substrate adjacent the well or recessed well can be scored so that, after purchase, the consumer can remove the goods packaging from the integral card substrate.

In one embodiment, "integral" means that the card and the goods container are formed from the same material and are unitary. For example, in the device shown in FIG. 1, the card 101, wall 107 with extensions 125 can be formed of a single piece of plastic. Likewise, for the device shown in FIG. 4, the card 101, recessed well 401 with side wall 403, upstanding wall 107 with cutouts 405 can be formed from a single piece of plastic. These single pieces of plastic can be molded as a unitary body. The cover and closure can be molded separately.

Figure 7A:
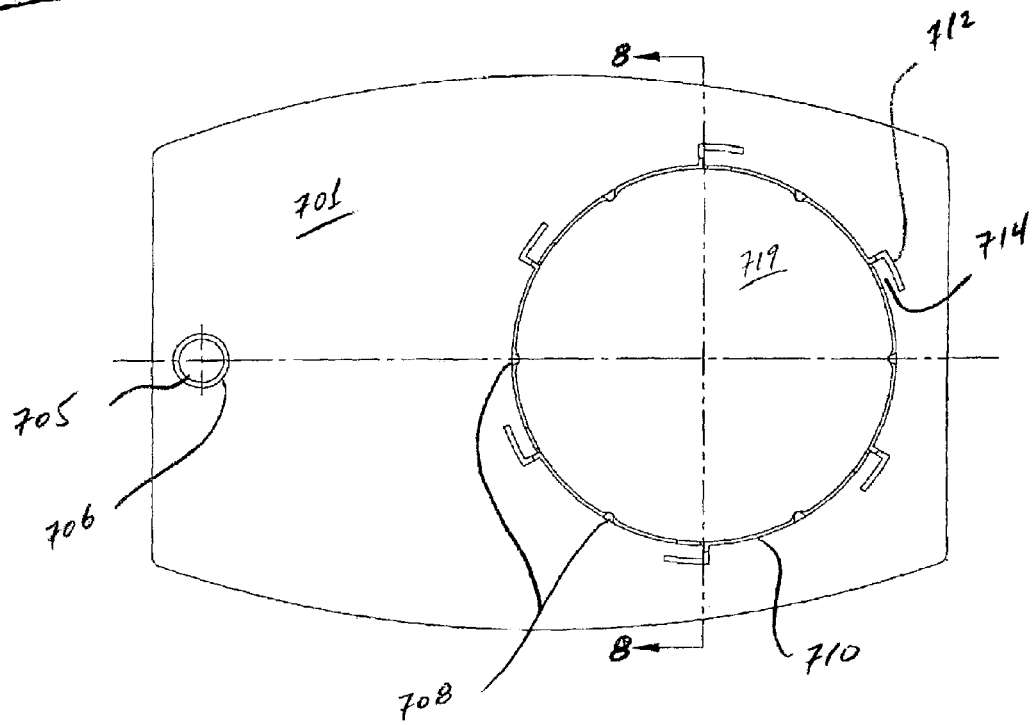
FIGS. 7A through 7C are plan, side, and perspective views of another embodiment of the invention where the card is integral with the cover.
Figure 7B:
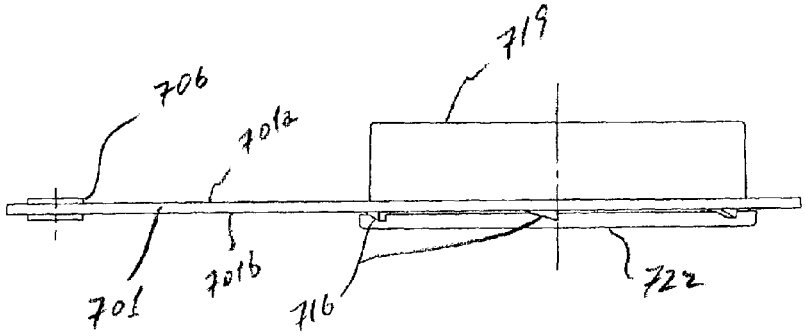
Figure 8:
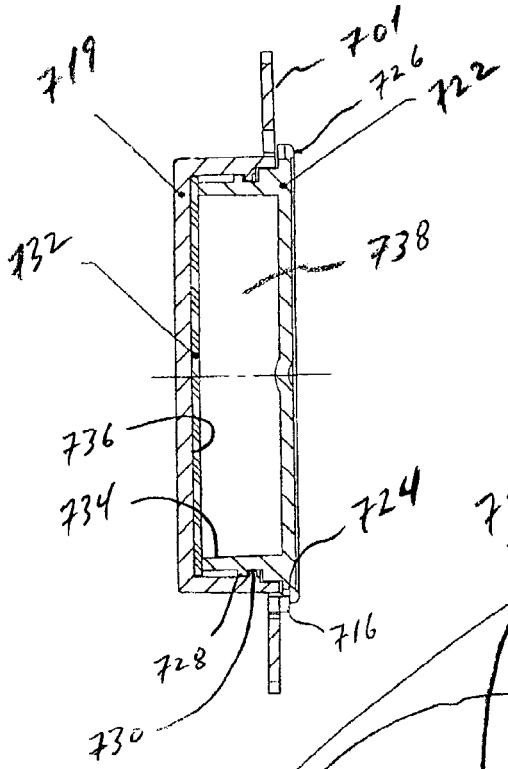
FIG. 8 is a cross-section taken along line 8—8 in FIG. 7A.
Figure 7C:
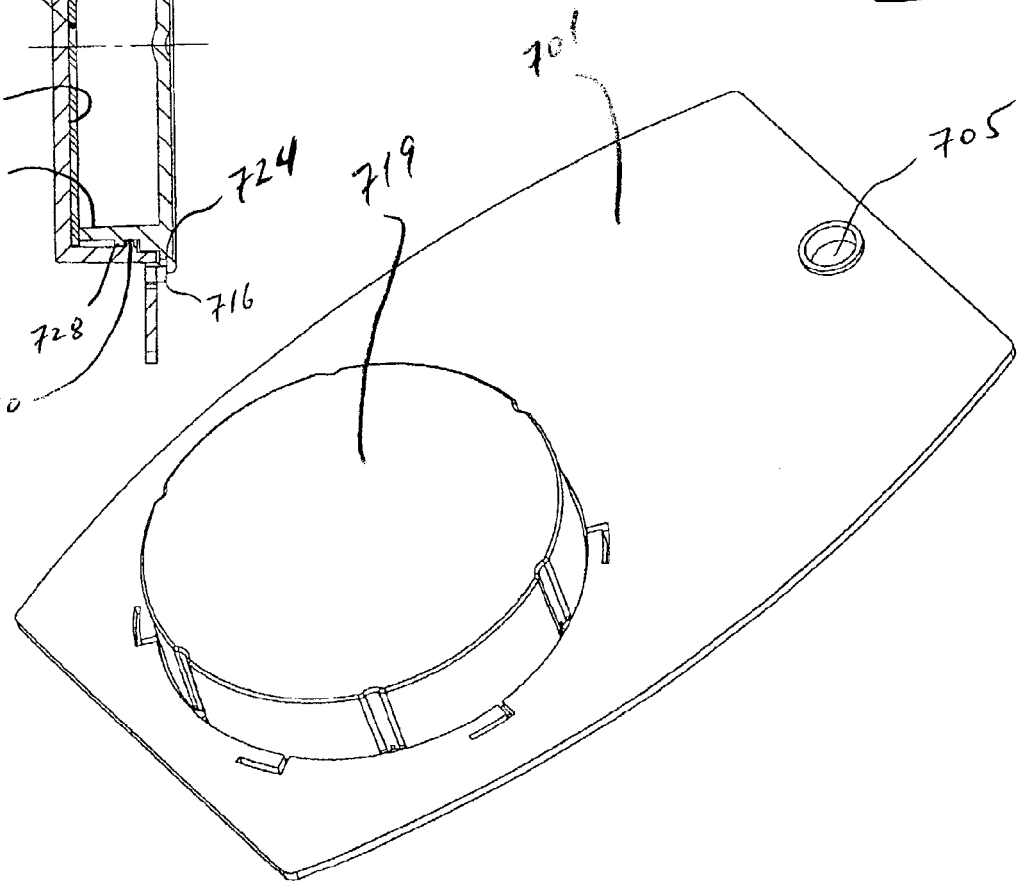

FIG. 7A is a plan view of one embodiment wherein the top 719 is integral with the card 701 having an opening 705 defined by a collar 706 from which the card can be hung (such as from a display peg). The top is attached to the card by a plurality of bridges 708, and otherwise separated, from the card by a plurality of scores 710 alternating with the bridges along the circumference of the top. The unitary, integral card and top are preferably made of plastic, such as a polyalkylene (e.g., polyethylene, polypropylene), polyamide (e.g., a Nylon), or any other polymer sufficiently rigid to hold its shape, be scored, be displayed, and the top separated from the scoring as required for the instant device to be functional (e.g., a polystyrene, polycarbonate, or polyacrylate, optionally plasticized). Separate L-shaped scores connecting with the circumferential scores are made to define fingers 714 also extending circumferentially around the top. As shown in FIG. 7B, the card 701 has a front side 701*a* and a rear side 701*b*. The part of the finger on the rear side defines an extending pawl 716 that engages the bottom 722. As shown in FIG. 8, a cross-section taken along line 8—8 of FIG. 7A, each pawl engages a depression or catch 724 formed in a circumferential flange 726 around around the bottom. Corresponding threads in the bottom 728 and the top 730 engage to enable the bottom to be screwed into the top. As the bottom is tightened, the pawls eventually engage the depressions to lock the bottom in place. Preferably, a sealing layer or liner 732 is disposed between the top of the side wall 734 of the bottom portion and the inside of the top wall 736 of the top. The side wall of the bottom portion, along with the bottom, defines an interior space 738 in which the goods (not shown) are stored. Preferably, the travel of the bottom into the top is very small, so that the thread need only comprise a fraction of the length of the circumference.

The card faces 701*a* and/or 701*b* can be printed with advertising and/or directional use instructions for the product, and preferably include instructions for detaching the sealed compact from the card.

Of course, depending on the display desired, the device can be designed with face 701*a* or face 701*b* as the front (the other being the back), even though the invention has been described above as the "top" being integral with the card. Addtionally, the integrated card/top and the bottom can be made from different, or differently colored, plastics.

In the use of such an embodiment, the goods are placed in the bottom portion, the sealing liner applied, and the bottom screwed into the top portion integral with the card; any printing on the integrated card/top having been done previously. The card is displayed, and after purchase by the consumer, the compact container with the bottom sealed to the top is broken away from the card by breaking the bridges interleaved with the score lines. After the container is separated from the card, it can be used as a typical cosmetics compact.

Prior to separating the compact from the card, the unitary top/card with the screwed-in bottom secured by the pawls is a tamper-evident container. Once the bottom is screwed into the top and engaged by the pawls, there is no need for an additional seal (such as a shrink wrap or clamshell). Further, the bottom cannot be unscrewed without damaging the pawls and/or the card, thereby evidencing tampering. When so sealed, the device is securely sealed and remains a unitary article until the combined top/bottom container is separated from the card by the consumer.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A combination container and display card, comprising:

a display card;

a container having a top wall from which extends a downstanding side wall, the free end of the side wall defining a bottom opening of the container, the side wall having an outer surface being integral with the display card through a plurality of bridges connecting the display card and the side wall, and spaced from the display card by a plurality of interspaced scores, the container able to be separated from the display card, and the side wall having means for cooperatively engaging a bottom; and a removable bottom of the container able to cooperatively engage and close with said container.

2. The device of claim 1, wherein the bottom and the display card mechanically engage in a cooperating manner to prevent the bottom from being removed from the display card.

3. The device of claim 1, wherein at least one of the display card and the bottom includes a plurality of pawls and the other includes a plurality of catches for engaging the pawls.

4. The device of claim 1, wherein the container and the card are made from polypropylene.

* * * * *

UNITED STATES PATENT AND TRADEMARK OFFICE

CERTIFICATE OF CORRECTION

PATENT NO. : 7,316,316 B2
APPLICATION NO. : 10/392033
DATED : January 8, 2008
INVENTOR(S) : Carl Lombardi, Jack Albanese and Morris Sussman It is certified that error appears in the above-identified patent and that said Letters Patent is hereby corrected as shown below:

Title page item 57
In the Abstract, line 1, delete "integred" and insert --integral--.

Signed and Sealed this

Eighth Day of July, 2008

JON W. DUDAS
*Director of the United States Patent and Trademark Office*